United States Patent [19]

Beach et al.

[11] 4,425,771

[45] Jan. 17, 1984

[54] COMBINED MAGNETIC AND NON-MAGNETIC LOCKING MECHANISM

[76] Inventors: Russell J. Beach, 2113 W. 177th St., Torrance, Calif. 90504; Jess R. Bateman, 1516 Esplanade Ave., Redondo Beach, Calif. 90277; Robert L. Carpenter, 12,032 Freeman Ave., Hawthorne, Calif. 90250

[21] Appl. No.: 253,248

[22] Filed: Apr. 13, 1981

[51] Int. Cl.[3] ..... E05B 35/04; E05B 47/02; E05C 17/56

[52] U.S. Cl. ..... 70/276; 70/134; 70/387; 292/251.5

[58] Field of Search ..... 70/276, 279, 134, 387; 292/307 R, 251.5

[56] References Cited

U.S. PATENT DOCUMENTS

| | | | |
|---|---|---|---|
| 707,757 | 8/1902 | Bryda | 70/134 |
| 1,593,683 | 7/1926 | Anakin | 70/276 |
| 2,931,953 | 4/1960 | Barney | 70/387 |
| 3,069,193 | 12/1962 | Kirk . | |
| 3,395,555 | 8/1968 | Hickman | 70/276 |
| 3,494,157 | 2/1970 | Coker | 70/276 |
| 3,605,459 | 9/1971 | Van Dalen . | |
| 3,731,963 | 5/1973 | Pond . | |
| 3,785,188 | 1/1974 | Drathschmidt | 70/276 |
| 3,942,345 | 3/1976 | Sasahara | 70/276 |
| 4,022,038 | 5/1977 | Miller | 70/276 |
| 4,026,134 | 5/1977 | Woolfson | 70/276 |

*Primary Examiner*—Gary L. Smith
*Assistant Examiner*—Lloyd A. Gall
*Attorney, Agent, or Firm*—Poms, Smith, Lande & Rose

[57] ABSTRACT

A locking and release mechanism includes two interlocked members, and two detents which hold the two interlocked members together. One of the two detents is magnetically operated and the other is mechanically operated. The mechanically operated detent involves the use of a mechanical operating member which moves through a channel, and an additional movable magnetic element which selectively blocks the channel. A special release member, which may be thought of as a key, carries both the mechanical member for extending through the channel and two magnets for operating the magnetically-operated detent, and the movable blocking member for the mechanically operated latch.

6 Claims, 6 Drawing Figures

COMBINED MAGNETIC AND NON-MAGNETIC LOCKING MECHANISM

FIELD OF THE INVENTION

This invention relates to locking devices, and more particularly to locking devices employing permanent magnets in the release mechanism.

BACKGROUND OF THE INVENTION

It has previously been proposed to use permanent magnets and electromagnets in the operation of latches and locks. Typical prior art arrangements of this type include U.S. Pat. Nos. 3,069,193, 3,605,459, and 3,731,963. However, these mechanisms are relatively complex, or do not afford adequate security against entry.

Accordingly, a principal object of the present invention is to provide a simple locking mechanism which operates on an unusual combination of mechanical and magnetic operational principles, so that it has a high degree of security.

SUMMARY OF THE INVENTION

In accordance with a specific illustrative preferred embodiment of the invention, two interlocked members are held together by a pair of detents, with one of the detents being operated by a permanent magnet, and the other detent being operated by an elongated mechanical pin which passes through an extended channel. Blocking the channel is a magnetic member which is moved out of the path of the release pin by a second permanent magnet. The two permanent magnets and the release pin are carried on a single release member which is carried by authorized persons and which serves as a key. The two permanent magnets must be properly positioned on the release member relative to the releasing pin, so that the functions as described above operate in proper sequence, and so that both of the detents are retracted at the same time.

In accordance with a somewhat broader aspect of the invention, for reduced security applications, the magnetically operated detent may be dispensed with, and the two interlocked members may be held together solely by the mechanical detent with a degree of security being provided by the magnetic element blocking the channel through which the mechanical release pin passes.

In accordance with another somewhat broader aspect of the invention, a single detent may be employed to hold two members together; a release means may be provided for physically moving the detent to unlock the two members; an element is provided for blocking the operative movement of the release means, and arrangements are provided for shifting the blocking means to unblock the release means; with said release means and said shifting means including one magnetically operated and one mechanically operated arrangement.

Other objects, features, and advantages of the invention will become apparent from a consideration of the following detailed description and from the drawings.

DETAILED DESCRIPTION

Figure 1:
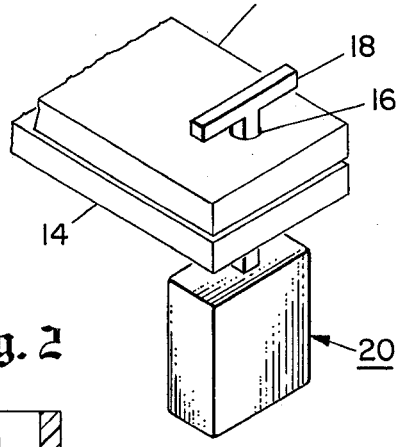
FIG. 1 illustrates the lock arrangements of the present invention without the presence of the key element.

FIG. 1 shows two members 12 and 14 which have a hole 16 extending through the upper member 12 and a similar aligned hole extending through the lower member 14. The assembly includes a T-bar member 18 and a lock casing 20 holds the two elements 12 and 14 together and precludes their separation until the T-bar 18 is released from the lock housing 20.

Figure 3:
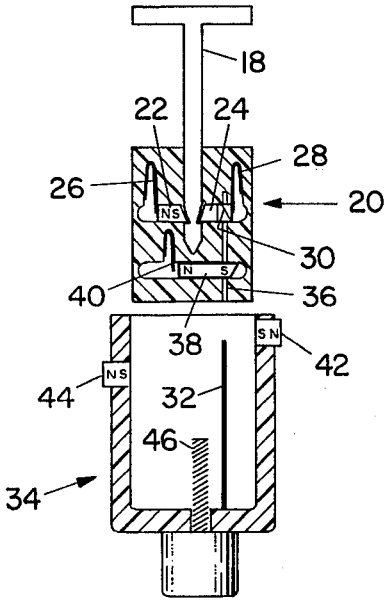
FIG. 3 is a cross-sectional showing of the lock element toward the top, and the key or release element below, prior to their assembly with one another.

The interior construction of the T-bar 18 and the lock housing 20 is shown in the upper portion of FIG. 3. More specifically, the T-bar 18 is held into the lock assembly 20 by two detents 22 and 24. These two detents 22 and 24 are urged in toward the T-bar 18 by the small biasing leaf springs 26 and 28, respectively. The detent 22 is a permanent magnet, as indicated by the letters "N" and "S" which appear thereon.

The detent 24 is made of non-magnetic material, so it cannot be operated by a magnet, and includes a recess with a slanted surface 30 thereon, so that when the pin 32 forming part of the release assembly 34 passes through the channel 36, it will bear on the slanted surface 30 and shift the non-magnetic detent 24 to the right, releasing the T-bar 18.

Blocking the channel 36 is a second permanent magnet 38 which is biased to the right as shown in FIG. 3 by an additional leaf spring 40. When the permanent magnet 42 is brought close to the right-hand end of permanent magnet 38 when the key structure 34 is raised, the permanent magnet 38 is pushed to the left, by the repulsion force of the two adjacent like magnetic poles, and the release member or pin 32 may pass up through the channel 36, engage the surface 30, and release the T-bar 18. It may be noted that the permanent magnet 42 is located immediately adjacent the outer end of the pin 32 to assure proper action of the type described hereinabove.

The second permanent magnet 44, having a polarity indicated by the letters "N" and "S" thereon, serves to actuate the second detent 22 and draw it out of engagement with the left-hand recess in the T-bar 18.

The spring 46 located at the base of the key assembly 34 aids in the disassembly of the lock member 20 from the key assembly 34 following the release of the T-bar 18. As shown to advantage in FIG. 2, a large leaf spring 48 holds the key assembly 34 in its proper operative position relative to the lock assembly 20 during the release operation; and assures alignment of pin 32 with recess 36.

Figure 4:
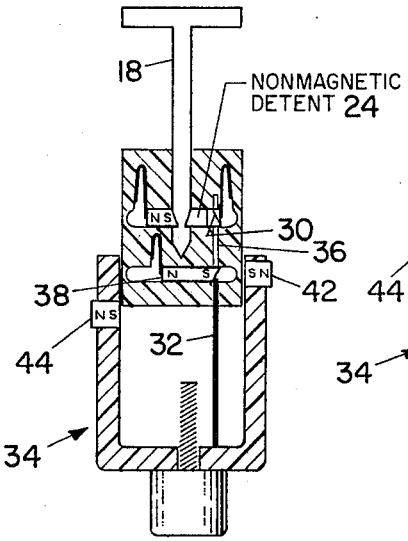
FIGS. 4 through 6 show the successive steps in the release operation as the key element is assembled with the lock element.
Figure 5:
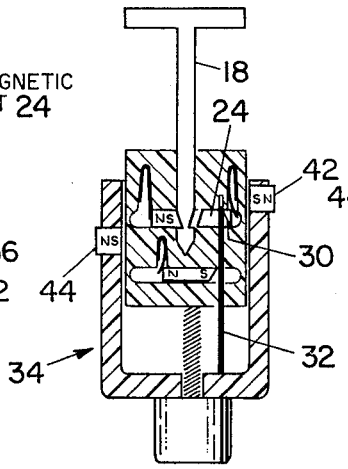
Figure 6:
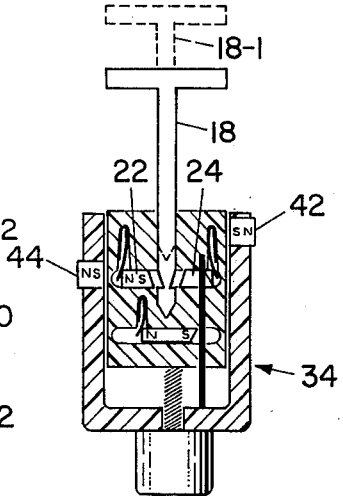

FIGS. 4, 5 and 6 show the successive steps of the release function as described briefly hereinabove in connection with FIG. 3. More particularly, in FIG. 4, the first step is shown, wherein the oppositely poled magnets 42 and 38 cause the displacement of the blocking magnet 38 to the left, and permits the pin 32 to pass upwardly through the channel 36 toward engagement with the non-magnetic detent 24 and more particularly into engagement with its slanted surface 30.

In FIG. 5 the upper end of the pin 32 has engaged the slanted surface 30 of the detent 24, and has moved this detent out of engagement with the right-hand recess in the T-bar 18.

In FIG. 6, the final step is shown, whereby unlike poles of the magnet 44 and the magnetic detent element 22 have attracted one another and pulled the detent 22 to the left as shown in FIG. 6, and out of the left-hand detent in the T-bar 18. With both detents 24 and 22 now having been disengaged from the recesses in T-bar 18, by the advancing key assembly 34, the T-bar 18 may now be raised, as indicated by the dashed lines designated 18-1 in FIG. 6.

Figure 2:
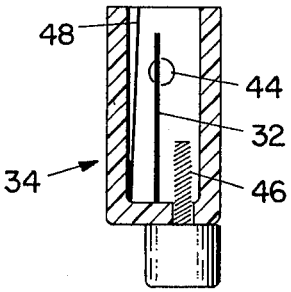
FIG. 2 shows the assembly forming the key element which releases the mechanism of FIG. 1.

The lock structure as shown in FIG. 2 may be used, for example, to retain utility meter boxes closed, with the utility company employee being provided with the key structure 34. Alternative cross-sectional configurations for the lock member 20 and mating recess of the key member 34, may be used; and the positions of the detents may be varied, to increase security.

It is to be understood that the foregoing description merely relates to one illustrative preferred embodiment of the invention. Other arrangements using somewhat different mechanical implementation may be employed. Thus, by way of example, and not of limitation, instead of using the non-magnetic detent 24, a magnetic element could be employed, with a non-magnetic element blocking the movement of the magnetic latch; and this magnetic element being released by mechanical displacement of the non-magnetic blocking element by the pin, and the concurrent or immediately subsequent shifting of the magnetic detent by a magnet similar to magnets 42 or 44. Other similar mechanical changes may be utilized, using an alternative key assembly structure, coil springs instead of leaf springs, and the like. Accordingly, it is to be understood that the present invention is not limited to that precisely as shown and described hereinabove.

What is claimed is:

1. A release mechanism including both mechanical and magnetically operated detents comprising:

two interlocked members;

a non-magnetic detent or latch means for holding said two members together;

a mechanical release means for physically moving said nonmagnetic detent or latch means;

a magnetic element for blocking the operative movement of said mechanical release means;

magnetic means for shifting said magnetic blocking element to unblock said mechanical release means as it reaches said magnetic blocking element;

key assembly means for supporting and mounting said mechanical release means; and said key assembly means being hollow.

2. A locking and release mechanism as defined in claim 1 wherein said mechanical release means is an elongated pin.

3. A locking and release mechanism as defined in claim 1 wherein said non-magnetic detent and said blocking element are mounted on a single lock assembly.

4. A locking and release mechanism including both mechanical and magnetically operated detents comprising:

two interlocked members;

magnetic and non-magnetic detent or latch means for holding said two members together;

a mechanical release means for physically moving said non-magnetic detent or latch means;

a movable magnetic element for blocking the operative movement of said mechanical release means;

first magnetic means for shifting said magnetic blocking element to unblock said mechanical release means as it reaches said magnetic blocking element;

second magnetic means for releasing said magnetic detent or latch means simultaneously with the release of said non-magnetic latch means by the mechanical release means;

key assembly means for supporting and mounting said mechanical release means, and said first and second magnetic means; and said key assembly means being hollow.

5. A locking and release mechanism as defined in claim 4 wherein said magnetic and non-magnetic detents and said blocking element are mounted on a single lock assembly.

6. A locking and release mechanism as defined in claim 4 wherein said magnetic detent, said magnetic blocking element, and said first and second magnetic means are all permanent magnets, and wherein said mechanism includes at least one repulsion actuated magnetic member.

* * * * *